United States Patent [19]

Italiano

[11] 4,441,830

[45] Apr. 10, 1984

[54] PRINTING SOLENOID

[75] Inventor: Victor J. Italiano, Ithaca, N.Y.

[73] Assignee: NCR Corporation, Dayton, Ohio

[21] Appl. No.: 363,361

[22] Filed: Mar. 29, 1982

[51] Int. Cl.[3] ..... B41J 3/12
[52] U.S. Cl. ..... 400/124; 101/93.05
[58] Field of Search ..... 400/121, 124; 101/93.05

[56] References Cited

U.S. PATENT DOCUMENTS

| | | | |
|---|---|---|---|
| 3,755,700 | 8/1973 | Buschmann et al. | 400/124 X |
| 3,787,791 | 1/1974 | Borger et al. | 400/124 X |
| 3,897,865 | 8/1975 | Darwin et al. | 400/124 |
| 4,022,311 | 5/1977 | Krull | 400/124 X |
| 4,260,269 | 4/1981 | Peroutky | 400/121 |

FOREIGN PATENT DOCUMENTS

| | | | |
|---|---|---|---|
| 2437301 | 4/1975 | Fed. Rep. of Germany | 400/124 |

OTHER PUBLICATIONS

*IBM Tech. Disc. Bulletin,* by T. H. Anderson, vol. 22, No. 4, Sep. 1979, pp. 1589–1592.

*IBM Tech. Disc. Bulletin,* by R. G. Cross, vol. 23, No. 5, Oct. 1980, pp. 1765–1766.

*Primary Examiner*—Paul T. Sewell

*Attorney, Agent, or Firm*—J. T. Cavender; Wilbert Hawk, Jr.; George J. Muckenthaler

[57] ABSTRACT

A dot matrix print actuator of low cost and compact rectangular design is constructed of flat, mild steel stock. An armature is engageable with a spring loaded print wire which is guided through a passageway in the poles of the actuator which are on either side of a bobbin containing coil.

3 Claims, 5 Drawing Figures

PRINTING SOLENOID

BACKGROUND OF THE INVENTION

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally secured to the solenoid plunger or armature which is caused to be moved such precise distance when the solenoid coil is energized and wherein the plunger normally operates against the action of a return spring.

It has also been quite common to provide an arrangement or grouping of such solenoids in a circular configuration to take advantage of reduced space available in the manner of locating the print wires in that area from the solenoid to the front tip of the print head near the record media. In this respect, the actuating ends of the print wires are spaced in accordance with the circular arrangement and the operating or working ends of the print wires are closely spaced in vertically aligned manner adjacent the record media. The availability of narrow or compact actuators permits a narrower print head to be used and thereby reduces the width of the printer because of the reduced clearance at the ends of the print line. The print head can also be made shorter because the narrow actuators can be placed in side-by-side manner closer to the record media for a given amount of wire curvature.

Further, it is also common to provide a plurality of single wire actuators or solenoids which may be equally spaced one from another along a line of printing and wherein the spacing between the solenoids is generally in the range of one half to one inch. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

The axial wire solenoids are typically built from cylindrical components for two major reasons. First, it is said that the force generated by the magnetic field is proportional to the change in permeance of the magnetic circuit with air gap length. Permeance is defined as the reciprocal of reluctance, and further defined that in a plane through any cross section of a tubular portion of a magnetic circuit bounded by lines of force and by two equipotential surfaces, is the ratio of the flux to the magnetic potential difference between the surfaces under consideration. A certain amount of the fringing flux exists at the edges of the air gap in a solenoid and due to the circuitous path of the flux the fringing flux contributes a small amount or proportion of the force generated in the solenoid. A circular cross-section at the pole face will obviously have the smallest perimeter and the least amount of fringing flux. Secondly, it should be noted that a cylindrical design employs both a cylindrical armature and a cylindrical coil closely coupled therewith, with the result that less copper per turn is utilized in the assembly of the solenoid, thereby increasing the efficiency of the unit.

While the cylindrical units can claim certain advantages as mentioned just above, it is seen that small and compact actuators of different configuration and construction are advantageous along a line of printing for effecting or enabling an increase in throughput or an improvement in print quality. Such small and compact actuators of rectangular design allow a reduction in distance between print wires of adjacent actuators and also reduce the length of the print head.

Representative documentation in the design of a matrix print actuator includes U.S. Pat. No. 3,755,700, issued to H. Buschmann et al. on Aug. 28, 1973, which discloses an electromagnetic drive having an armature guided in the pole shoes and attached to a print needle. The armature has a portion formed to receive a helical spring at one end and the other end engages a threaded pin.

U.S. Pat. No. 3,775,714, issued to H. Heuer on Nov. 27, 1973, includes a core portion and a plunger freely disposed within the sleeve-shaped inner core portion and operatively connected with indicating means.

U.S. Pat. No. 3,850,278, issued to H. P. Mihm et al. on Nov. 26, 1974, discloses a printing needle which is connected to the armature of an electromagnet by means of a thickened portion at one end of the needle and then fastened to the armature by peening, or the needle could be connected by flattening the end of the needle and then pivoting same to a hinge type of armature.

U.S. Pat. No. 4,016,965, issued to R. L. Wirth on Apr. 12, 1977, discloses a solenoid driver wherein the print wire is fastened to the plunger and the flanged end of the plunger provides a seat for the return spring and also a flux path from the air gap to the plunger.

U.S. Pat. No. 4,034,841, issued to S. Ohyama et al. on July 12, 1977, shows a print wire solenoid device including a disc type plunger restoring spring which is not secured at any point to the plunger nor to adjacent components, and the device is made with a conical formation of the plunger and stem members to reduce size and weight of the device.

U.S. Pat. No. 4,137,513, issued to J. W. Reece et al. on Jan. 30, 1979, discloses a matrix print wire solenoid having an armature or plunger core secured to the print wire and a return spring has one end seated over a portion of the armature and the other end seated in a recess of a plastic bushing.

U.S. Pat. No. 4,165,940, issued to C. T. Cacciola on Aug. 28, 1979, discloses a free flight, ballistic type head assembly with print wires and springs engageable with a wire end cap and an armature assembly.

U.S. Pat. No. 4,211,495, issued to R. E. Einem et al., discloses a print head made with a plastic lamination and one or two grooved plates which are initially flat and easy to mold in a manner for close solenoid spacing.

U.S. Pat. No. 4,211,496, issued to J. E. Naylor on July 8, 1980, discloses a printing solenoid with a compression spring biasing an armature at one end and engageable with a front guide piece.

And, U.S. Pat. No. 4,218,150, issued to R. L. Swaim on Aug. 19, 1980, discloses a moving coil mechanism in a matrix printer wherein the mechanisms are built in a nested arrangement to contribute to the compactness of the printer.

SUMMARY OF THE INVENTION

The present invention relates to matrix printers, and more particularly, to the design of a compact wire matrix print actuator. The design is directed to an actuator or solenoid type device which is generally in the shape of a narrow rectangular unit. A number of these rectangular units are assembled to make a print head which will occupy less space in a matrix printer. The print head is constructed by assembling individual units in side-by-side manner to reduce the distance between the print wires of adjacent actuators and also to reduce the length of the print head.

The individual actuators are made by means of a fine blanking or stamping process using mild steel stock for the various planar metallic parts. A print wire is spring-urged against an armature which is like biased against an end cap to maintain an air gap between the armature and the pole pieces of the solenoid. The print wire is free of the armature and allows ballistic flight of the wire under large print gap conditions. The ballistic operation permits the use of a smaller, more efficient stroke and provides for more equal impact forces over a large range of print gaps. A pair of irregular-shaped, flat pole pieces are formed to receive a bobbin around which is wound a wire coil. When the wire coil is energized, the armature is caused to be moved forward and thereby drive the print wire a small precise distance to the paper or like record media to effect the printing of a dot. A metallic washer surrounds a portion of the armature to provide for a return flux path. The several non-metallic parts include the end cap along with a guide for the print wire, a spring seat and the bobbin for the coil.

In view of the above discussion, the principal object of the present invention is to provide a generally rectangular, compact print wire actuator.

Another object of the present invention is to provide a method of making a compact print wire actuator at lower cost.

An additional object of the present invention is to provide a compact print wire actuator which results in a reduced distance between print wires and a reduced length print head when a plurality of the individual actuators are assembled.

A further object of the present invention is to provide a process for making the several parts of a compact print wire actuator by means of fine blanking or stamping the metallic stock.

Another object of the present invention is to provide a print wire actuator which provides a large outer coil surface for convenient attachment of coil terminals and wires.

Additional advantages and features of the present invention will become apparent and fully understood from a reading of the following description taken together with the annexed drawing.

DESCRIPTION OF THE PREFERRED EMBODIMENT

Figure 1:
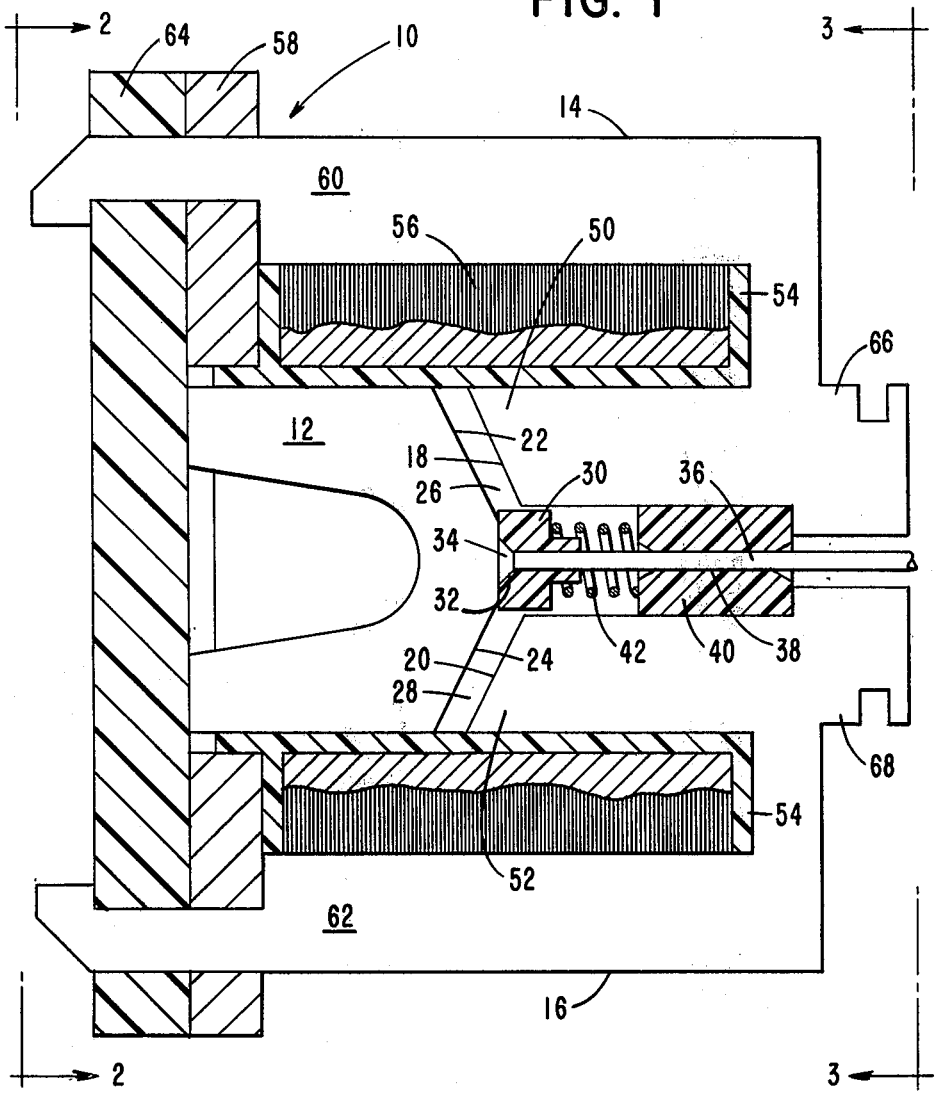
FIG. 1 is a side view in partial section of a print wire actuator made in accordance with the teaching of the present invention.

Referring to FIG. 1 of the drawing, a matrix print actuator or solenoid 10 is constructed in manner of design thereof in a generally rectangular shape and is made from low-cost parts and fabricated by means involving a low-cost blanking or stamping operation. An armature or plunger 12 of generally blunted-arrow shape is centrally positioned and faces portions of a pair of pole members 14 and 16 which include slanted or angled surfaces 18 and 20. The angle of surfaces 18 and 20 corresponds with the angle of surfaces 22 and 24 on the front of the armature 12 and thereby provides uniform air gaps 26 and 28 between the opposing armature and pole surfaces. The armature 12 has a central, generally U-shaped, rear portion cut out or removed therefrom for the purpose of reducing the mass of the unit. A central member or spring seat 30 of combined rectangular or substantially square and circular configuration is positioned forward of and abutting the armature 12 and includes a counter-sink 32 in the one end thereof abutting such armature 12 for reception of the flat head 34 of a print wire 36 which extends forward and is slidably contained through a hole or aperture 38 in a wire guide 40, also rectangular or substantially square shaped. The central member 30 and the print wire 36 may, if desired, be integrally molded as a single unit. A coil spring 42 is placed around a reduced diameter or step portion (circular configuration) of the central member 30, which portion serves as a seat for the spring 42 and which spring, in turn, urges the central member 30 against the armature 12. The spring 42 is thus contained between and tends to urge the central member or spring seat 30 with its captured print wire 36 against the armature 12 and away from the wire guide 40. The pole members 14 and 16 include step portions adjacent the front of the solenoid for retaining the wire guide 40 which, in turn, has its forward end thereof maintained in engagement with such step-like projections by reason of the force from spring 42.

The pole members 14 and 16 are irregular-shaped, flat pieces and include short end portions or legs 50 and 52 which include the angled surfaces 18 and 20, which lie adjacent the central member 30, the spring 42 and the wire guide 40, and which are formed to receive a flanged bobbin or spool 54 around which is wrapped a wire coil 56. The bobbin or spool 54 is rectangular shaped and preferably of single piece construction in the surrounding of a portion of the armature 12 and the end portions or legs 50 and 52 of the respective pole pieces 14 and 16. The end portions 50 and 52 extend to approximately the middle of the bobbin 54 and terminate with the angled surfaces 18 and 20 opposite the surfaces 22 and 24 of the armature 12. A rectangular-shaped steel washer 58 is placed at the rear of the bobbin 54 and is apertured to accept the long end portions or legs 60 and 62 of the pole pieces 14 and 16. Such washer 58 includes a rectangular opening sized to receive the base of the armature 12 and a projecting rectangular portion of the bobbin 54. The steel washer 58 thus serves to carry the flux in its return path around the armature 12. A rectangular-shaped plastic cap 64 is placed over and is in surface contact with the washer 58 and also includes apertures for the tips of the end portions 60 and 62, which tips may be twisted or bent in a crimping manner for retaining the overall assembly of parts.

As understood from FIG. 1, the various parts of the actuator or solenoid 10 are thus captured or contained in the lengthwise direction, left to right, by the tips of the long end portions 60 and 62 of the pole pieces 14 and 16 being bent or deformed over the plastic cap 64. The several parts of the actuator 10 are contained in the depthwise direction, viewed into the plane of FIG. 1, by the rectangular bobbin 54 which surrounds a portion of the armature 12, the spring seat 30, the spring 42 and the wire guide 40. A mounting means comprising slotted extensions 66 and 68 of the pole pieces 14 and 16 are provided for convenient attaching of the actuator or solenoid 10 within a carriage aperture (not shown) and retained with a suitable clip (also not shown).

Figure 2:
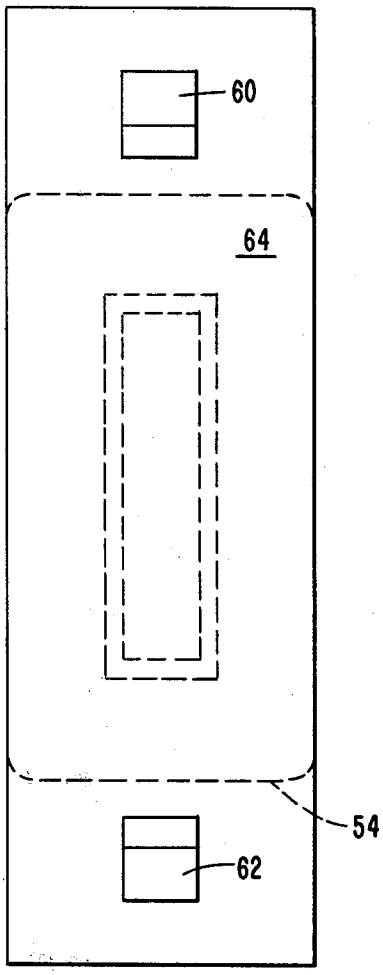
FIG. 2 is a view taken along the line 2—2 of FIG. 1.

FIG. 2 illustrates an end view of the actuator 10 and includes the rectangular plastic cap 64 receiving the ends 60 and 62 of the pole pieces 14 and 16 for containing the several parts in an assembled condition. The view also shows the rectangular shape of the bobbin 54 in dotted lines.

Figure 3:
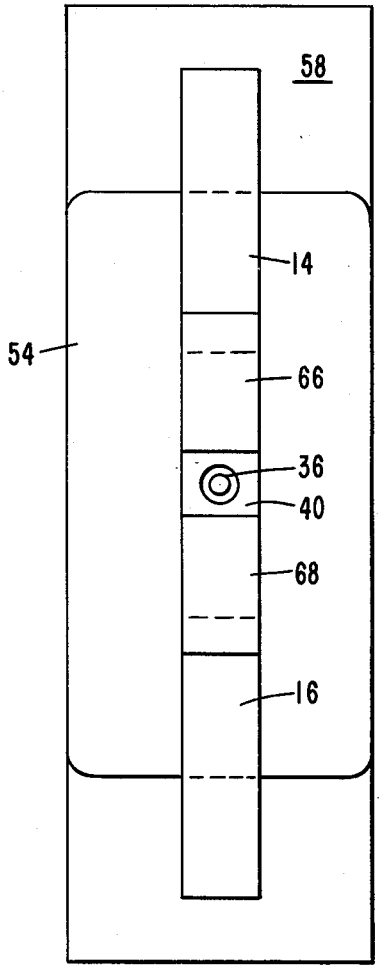
FIG. 3 is a view taken along the line 3—3 of FIG. 1.

FIG. 3 illustrates a frontal end view of the actuator 10 and includes the flat-shaped pole pieces 14 and 16 along with the print wire 36 slidably contained in the wire guide 40. The extensions 66 and 68 are also shown as part of the pole pieces 14 and 16.

Figure 4:
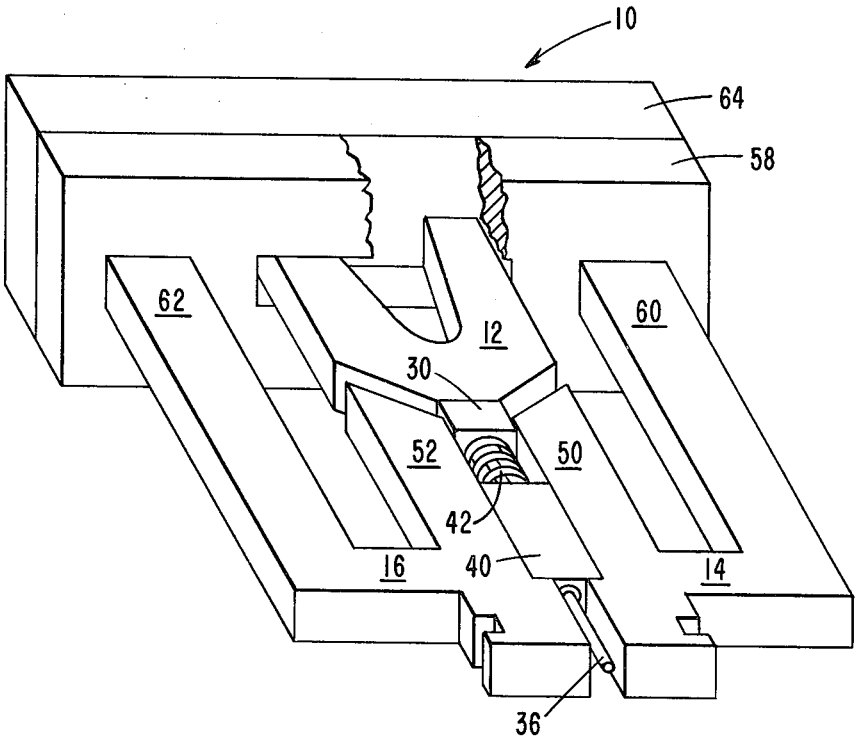
FIG. 4 is a perspective view of the print wire actuator.

A perspective view of the print wire actuator 10 is illustrated in FIG. 4 to show the generally flat and rectangular construction thereof but with the bobbin and the wire coil removed to show more clearly the form of the several parts in the assembled arrangement.

Figure 5:
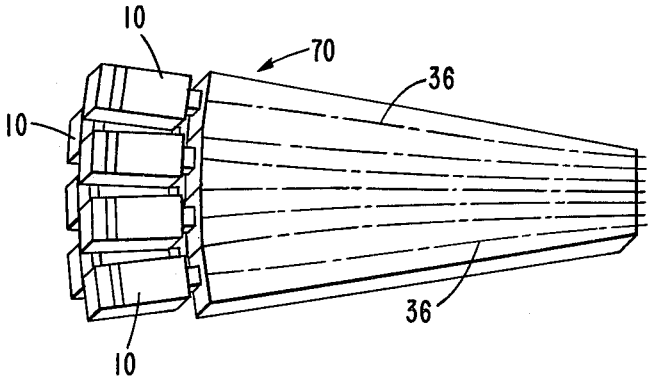
FIG. 5 is a perspective view in diagrammatic form of a print head made by assembling a plurality of the individual print wire actuators.

FIG. 5 is a perspective view in diagrammatic form of a print head 70 made by assembling a plurality of the rectangular-shaped solenoids 10 with their print wires 36. In the arrangement shown, there are four of the solenoids 10 stacked proximal the observer and three solenoids 10 in distal relationship to form a narrow print head configuration. The rectangular arrangement herein may be contrasted with a representative print head assembly of cylindrical solenoids disclosed in U.S. Pat. No. 4,016,965. While the arrangement of seven of such solenoids 10 in the instant invention may be modified from that shown, the rectangular solenoids which are fabricated from flat stock material provide for a more compact print head and enable a reduction in space required for operation in a matrix type printer.

The flat stock material used in the process of making the solenoid is preferably 0.06 inch thick mild steel. It should be noted that the several parts made by such fine blanking or stamping process include the armature 12, the pole pieces 14 and 16 and the washer 58, and when assembled, as illustrated in FIG. 3, the width of such washer 58 defines an actuator or solenoid that is approximately 0.25 inch wide. The spring seat or central member 30 is made of acetal, the wire guide 40 is Delrin, the bobbin 54 is nylon and the end cap 64 is made from a suitable injection molded plastic. Delrin is a trademark of DuPont Company. The blanking or stamping process for making the several parts of the rectangular solenoid 10 reduces the cost thereof over the turning process for making cylindrical units.

It is thus seen that herein shown and described is a matrix type print actuator or solenoid that is rectangular shaped in design and is made from flat metal stock by means of a fine blanking or stamping process and is small and compact when assembled. The apparatus and arrangement enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

I claim:

1. A print wire actuating device of generally rectangular construction comprising a pair of spaced flat irregular-shaped electromagnetic pole pieces, each pole piece having a first portion and a second portion, an electromagnetic coil operably associated with said pole pieces, a plunger defining inclined surfaces on one end thereof and positioned in the same plane with said pole pieces and spaced from the first portion of each pole piece to provide an air gap between the surfaces of the plunger and the first portions and movable in said plane toward the first portions upon energization of said electromagnetic coil, a print wire disposed between said pole pieces and abutting said plunger and slidably operated thereby, resilient means for biasing said print wire and said plunger in one direction, and a flat rectangular apertured member for receiving said plunger and the second portion of each pole piece for securing the parts of the actuating device and positioned in relation to said coil and said plunger for providing a path for magnetic flux generated in response to energization of said coil.

2. The actuating device of claim 1 including a seat member abutting said plunger for receiving said print wire and enagageable by said resilient means.

3. A print wire solenoid of generally flat rectangular construction comprising a pair of spaced flat irregular-shaped electromagnetic pole pieces, each pole piece having a slanted first portion and a second portion, an electromagnetic coil operably associated with said pole pieces, an armature defining inclined surfaces on one end thereof and positioned in the plane with the pole pieces and spaced from the first portion of each pole piece to provide an air gap between the surfaces of the armature and the first portions and slidable toward the first portions upon energization of the coil, a print wire disposed between the first portions of the pole pieces and abutting the armature and slidably operated in ballistic manner thereby, resilient means for biasing the print wire and the armature in one direction, and a flat rectangular member apertured to receive the armature and the second portions of the pole pieces for securing the parts of the solenoid and positioned in relation to said coil and said armature for providing a path for magnetic flux generated in response to energization of said coil.

* * * * *